US005675134A

United States Patent [19]

Swart et al.

[11] Patent Number: 5,675,134

[45] Date of Patent: Oct. 7, 1997

[54] TRAFFIC ACCIDENT DETECTING SENSOR FOR A PASSENGER PROTECTION SYSTEM IN A VEHICLE

[75] Inventors: Martin Swart, Obertraubling; Josef Dirmeyer, Bodenwöhr; Gerhard Mader, Thalmassing; Helmut Bresgen, München; Günter Dissen, Taufkirchen, all of Germany

[73] Assignee: Siemens Aktiengesellschaft, Munich, Germany

[21] Appl. No.: 724,361

[22] Filed: Oct. 1, 1996

Related U.S. Application Data

[63] Continuation of Ser. No. 344,465, filed as PCT/DE93/00458, May 25, 1993, abandoned.

[30] Foreign Application Priority Data

May 25, 1992 [DE] Germany ..... 9207070 U

[51] Int. Cl.[6] ..... H01H 35/14

[52] U.S. Cl. ..... 200/61.45 M; 200/61.53

[58] Field of Search ..... 200/61.45 R–61.45 M

[56] References Cited

U.S. PATENT DOCUMENTS

| | | | |
|---|---|---|---|
| 3,132,220 | 5/1964 | Uri et al. | 200/61.45 M |
| 3,459,911 | 8/1969 | Fischer | 200/61.45 |
| 3,737,599 | 6/1973 | Zuvela | 200/61.45 R |
| 3,795,780 | 3/1974 | Lawrie | 200/61.45 R |
| 3,840,088 | 10/1974 | Marumo et al. | 180/105 R |
| 4,414,518 | 11/1983 | Farr | 335/205 |
| 4,877,927 | 10/1989 | Reneau | 200/61.45 M |
| 5,028,750 | 7/1991 | Spies et al. | 200/61.45 M |
| 5,194,706 | 3/1993 | Reneau | 200/61.45 R |
| 5,248,861 | 9/1993 | Kato et al. | 200/61.45 M |
| 5,416,293 | 5/1995 | Reneau | 200/61.45 M |

FOREIGN PATENT DOCUMENTS

| | | | |
|---|---|---|---|
| 2644606 | 4/1978 | Germany | H01H 35/06 |
| 3830782 | 6/1990 | Germany | H01H 36/00 |

*Primary Examiner*—Cassandra C. Spyrou
*Assistant Examiner*—Michael A. Friedhofer
*Attorney, Agent, or Firm*—Herbert L. Lerner; Laurence A. Greenberg

[57] ABSTRACT

A traffic accident detecting sensor for a passenger protection system in a vehicle includes a low-retentivity seismic mass which can move along a guide member between two extreme positions and is normally held in a first extreme position by a contact pressure. The contact pressure is overcome in the event of deceleration in such a way that the seismic mass then moves toward a second extreme position. A magnet being distinct from the seismic mass has a magnetic field which is deformed to a varying degree by the seismic mass depending on the position of the seismic mass. At least one contact can be controlled by the magnetic field of the magnet. The contact and the seismic mass have such a configuration that in the first extreme position the latter to a large extent constitutes a magnetic shunt diverting the magnetic field away from the contact toward the seismic mass so that the contact is then in its first contact state. The seismic mass does not constitute a magnetic shunt at points distant from the extreme position, so that the contact is then controlled in its other contact state under the effect of the magnetic field. The magnet forms the guide member or is rigidly connected to the guide member. The magnet is magnetized perpendicularly to the direction in which the seismic mass can move. The contact is disposed near a frontal surface of the guide member in such a way that the magnetic flux through the contact depends on the position of the seismic mass.

11 Claims, 10 Drawing Sheets

TRAFFIC ACCIDENT DETECTING SENSOR FOR A PASSENGER PROTECTION SYSTEM IN A VEHICLE

CROSS-REFERENCE TO RELATED APPLICATION

This application is a continuation of application Ser. No. 08/344,465, filed on Nov. 23, 1994 now abandoned, which is a Continuation of International application Ser. No. PCT/DE93/00458 filed May 25, 1993.

BACKGROUND OF THE INVENTION

Field of the Invention

The invention relates to a sensor which is suitable for detecting traffic accidents and which can reliably trigger a passenger protection system, that is to say an airbag system, a belt tightening system and/or a rollbar system, for example, in the event of a traffic accident. It is to be possible to apply the concept of the sensor according to the invention to front sensors and safing sensors, for example.

On one hand, because such sensors are usually placed anywhere within the vehicle, that is to say not directly at the impact point of the vehicle, the acceleration and deceleration values to be detected in the event of such an accident are usually small in comparison with values produced by a hard impact of a hammer on a hard object. On the other hand, the acceleration and deceleration values occurring during such an accident that are to be detected are usually large in comparison with values that occur in the vehicle during normal braking operations or normal acceleration operations as long as no accident occurs.

A large number of sensor types have been developed for passenger protection systems of vehicles, or are at least particularly suited to them. The various types are distinguished by the technical concepts on which they are based.

Thus, inter alia, there is one type of sensor in which the magnetic field of a magnet has a central function in the control of a switch. The switch is reliably able to trigger the passenger protection system, that is to say an airbag for example, during the traffic accident. Within that type of sensor, the invention relates to a specific type that utilizes the deformation of the magnetic field triggered by the traffic accident in a particular manner.

The invention namely proceeds from the specific sensor defined above which is known per se from U.S. Pat. No. 3,737,599.

That sensor already has a relatively simple and robust structure and is accordingly simple to manufacture.

A sensor which is similar in some respects but which has a relatively complicated construction is described in U.S. Pat. No. 4,877,027.

SUMMARY OF THE INVENTION

It is accordingly an object of the invention to provide a traffic accident detecting sensor for a passenger protection system in a vehicle, which overcomes the hereinaforementioned disadvantages of the heretofore-known devices of this general type and which offers a particularly space-saving, compact, reliable, robust configuration of sensor components and in addition permits a particularly uncomplicated, simple manufacture of the sensor.

With the foregoing and other objects in view there is provided, in accordance with the invention, a traffic accident detecting sensor for a passenger protection system in a vehicle, comprising a guide member having a guide axis extending in a given direction and having at least one end surface; a low-retentivity seismic mass being guided by the guide member for movement along the guide axis in a given direction between first and second extreme or end positions; means for normally pressing the seismic mass into the first extreme or end position with a contact pressure yielding or being overcome in the event of an acceleration or a deceleration acting substantially in the given direction of the guide axis for moving the seismic mass toward the second extreme or end position; a magnet being distinct or different from the seismic mass and having a magnetic field being deformed to a varying degree by the seismic mass in dependence on a position of the seismic mass; at least one contact to be controlled by the magnetic field of the magnet by directing a magnetic flux through the at least one contact in dependence on the position of the seismic mass; the at least one contact and the seismic mass causing the seismic mass to constitute a strong magnetic shunt to a substantial extent in the first extreme or end position and diverting the magnetic field away from the at least one contact and toward the seismic mass, for maintaining the at least one contact in a first contact state as long as the seismic mass remains in the extreme or end position, despite the presence of the magnetic field, and for preventing the seismic mass from constituting a magnetic shunt, or stopping the seismic mass from continuing to constitute a magnetic shunt being effective to the same extent, at points distant from the extreme or end position, for then controlling the at least one contact in another contact state under the effect of the magnetic field; the magnet forming the guide member or being rigidly connected to the guide member; the magnet being magnetized substantially perpendicularly to the given direction of movement of the seismic mass; and the at least one contact being disposed or brought substantially near an end or frontal surface of the guide member.

The invention thus offers a new type of sensor which can be disposed even in the smallest spaces of openings if required, for example even in an opening in the steering wheel together with an airbag and its controller. The sensor according to the invention also utilizes the magnetic field of a magnet to control a switch.

In accordance with another feature of the invention, the guide member has a strength of magnetization locally along the given direction of movement of the seismic mass, for constantly increasing a magnetic field component flowing through the seismic mass, and constantly decreasing the magnetic flux flowing through the at least one contact, during the movement of the seismic mass from the second extreme position to the first extreme position. This permits the action of a restoring force upon the seismic mass at every point between its two extreme positions. The restoring force pulls the seismic mass back into its first extreme position if there is no acceleration and no deceleration.

In accordance with a further feature of the invention, the guide member has a strength of magnetization locally along the given direction of movement of the seismic mass, for causing a magnetic field component flowing through the seismic mass in each case to have a sudden change in strength at a point between the extreme positions of the seismic mass, during movement of the seismic mass along the guide member. This permits the control of the at least one contact by the sudden changes in strength of the magnetic flux flowing through it instantly and precisely at the relevant point of the moved seismic mass, instead of in a less defined manner.

Namely, such a jump in the magnetization intensity of the guide member causes the magnetic flux through the at least one contact to change suddenly when the seismic mass moves past the point.

In accordance with an added feature of the invention, the sudden change in strength is caused by a geometric construction of the guide member causing the magnetic flux through the at least one contact to change suddenly as soon as the seismic mass moves past the point. This permits such a sudden change of the magnetic flux to be obtained in a particularly simple manner.

In accordance with an additional feature of the invention, the contact pressure is at least substantially generated by the magnetic flux flowing through the seismic mass. This permits a particularly simple construction of the sensor.

In accordance with a concomitant feature of the invention, the seismic mass is at least partially made of electrically conductive material. This permits the utilization of the eddy currents generated in the seismic mass when it is moved to dampen or to suppress fluttering of the seismic mass.

Other features which are considered as characteristic for the invention are set forth in the appended claims.

Although the invention is illustrated and described herein as embodied in a traffic accident detecting sensor for a passenger protection system in a vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
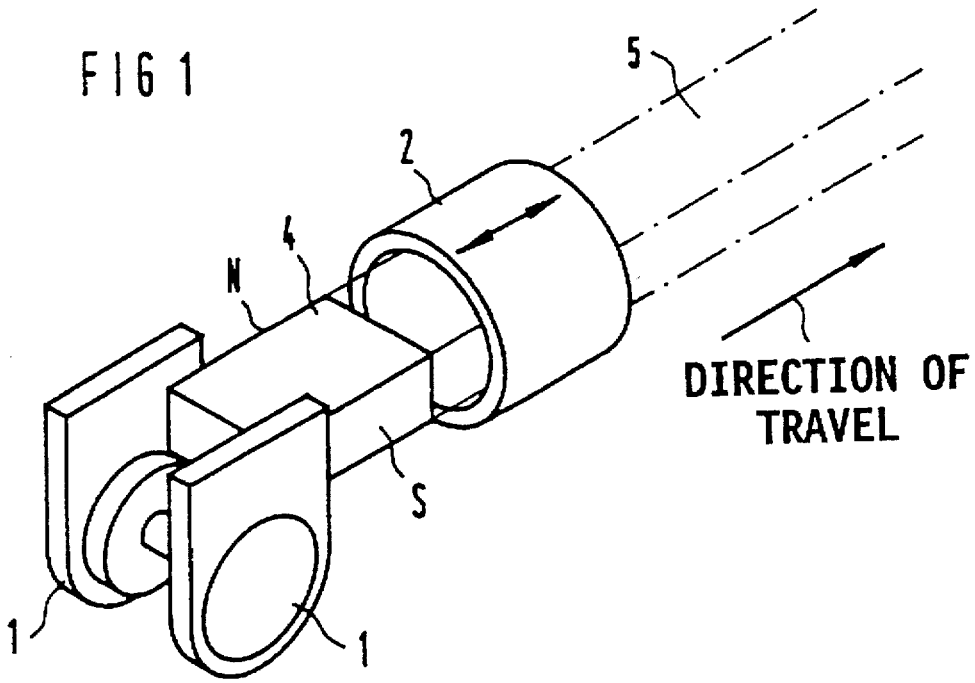
FIG. 1 is a diagrammatic, perspective overview of a first device for illustrating a concept according to the invention.
Figure 8:
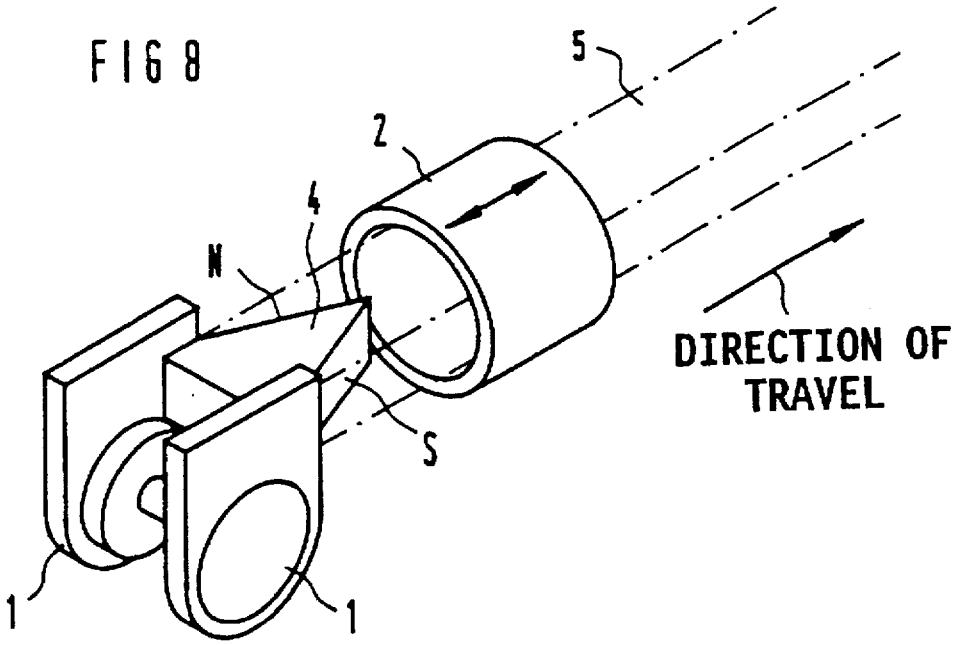
FIG. 8 is a perspective overview of a second device for illustrating a concept according to the invention.
Figure 9:
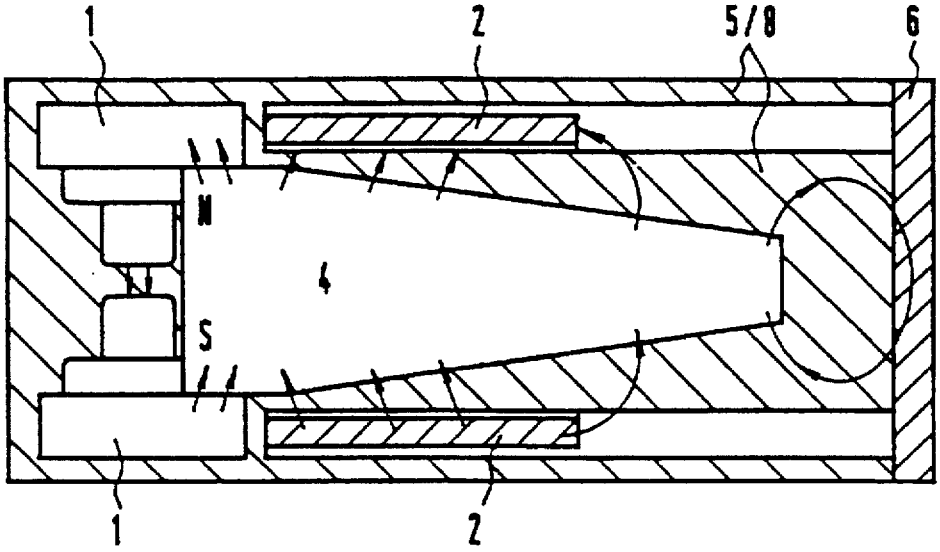
FIGS. 9 and 10 are sectional views of a fourth example of the invention.
Figure 10:
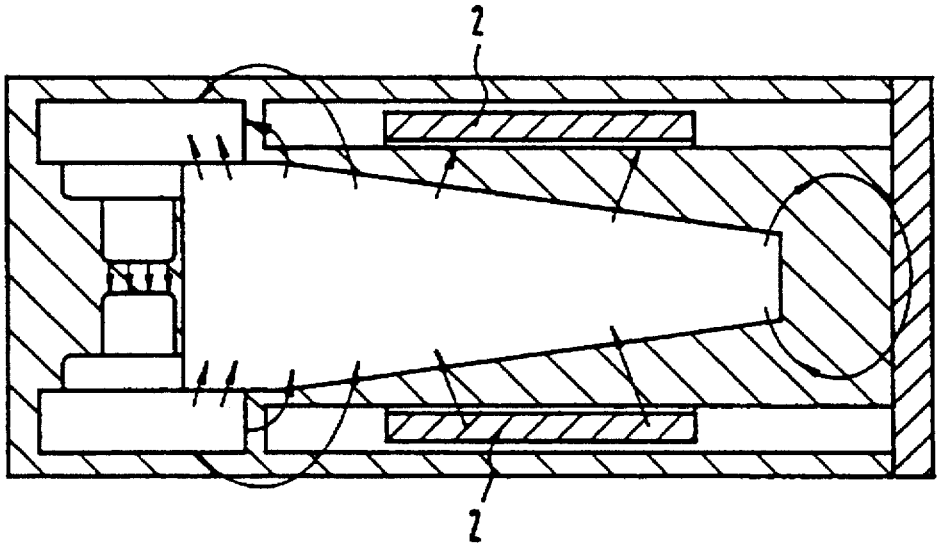
Figure 21:
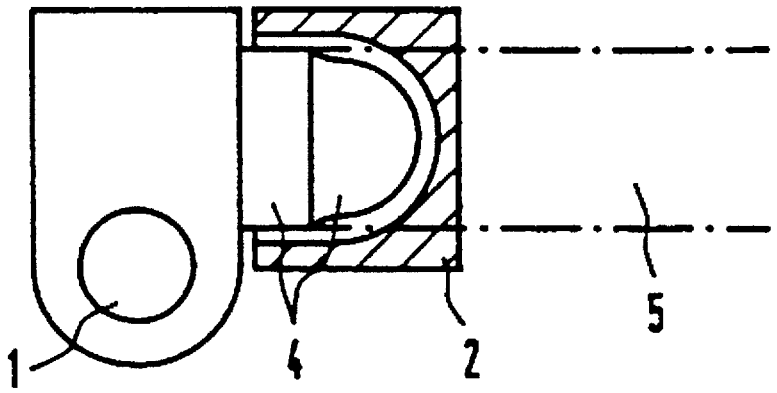
FIG. 21 is a sectional view of a further example of a sensor constructed in accordance with a concept of the invention.

Referring now in detail to the figures of the drawing, all of which relate to examples of sensors constructed according to the invention for a passenger protection system in a vehicle, and first, particularly, to FIGS. 1, 8 and 21 thereof, it is seen that all of the illustrated examples of the sensor constructed according to the invention have at least one electrical contact 1, for example one or more reed contacts 1, which can be driven magnetically between its switching states. In this case, the actual electrical contact-break of the contact 1 can be disposed directly at the sensor itself, as is the case, for instance, in the examples shown in FIGS. 1 to 5 and 8 to 16. However, it is also perfectly possible to place only a magnetically controllable component of the contact 1, for example a Hall element, at the sensor according to the invention, so that the component then switches the remaining components of the contact 1, namely a transistor for example, which are then disposed at a relatively large distance, as the actual electrical contact-break of the contact 1.

All of the examples shown, such as in FIGS. 1 to 5 as well as 8 to 16 and 21, in each case have a seismic mass 2 which is made of a low-retentivity mass, or at least contains such a mass, according to the invention. The seismic mass 2 is thus made of ferromagnetic or ferrimagnetic material, for example.

The seismic mass 2 is guided in each case along a guide axis of a guide member 5 that guides the seismic mass 2 and can be moved between two extreme positions, such as in FIGS. 1 to 5 and 8 to 16 as well as 21. Depending on the particular structure of the sensor, the guide member 5 is formed, for example, by inner surfaces of an external casing of the sensor, which is represented by reference numeral 7 in FIG. 2, 8 in FIGS. 9 and 10, 11 in FIGS. 11 and 12, 9 in FIGS. 13 and 14 as well as 13 in FIGS. 15 and 16. However, for the sake of clarity, the casing is not shown in all of the figures, such as in FIGS. 1, 3 to 5 and 8 as well as 21.

However, the guide member 5 can also have a quite different structure. Thus, for example, the seismic mass 2 can also be additionally or exclusively or partially guided by a surface, for example an outer surface, of a magnet 4 disposed in the sensor, or by a non-magnetic extension 5 of the magnet 4 disposed inside the sensor, on which the seismic mass 2 can glide, such as is represented by reference numeral 5 in FIGS. 1 to 5, and 8 to 16 and 21.

The seismic mass 2 can be moved between two extreme positions in the sensor. The seismic mass 2 is normally pressed by a contact pressure into its first extreme position and thus into its rest position, namely as long as no traffic accident occurs. In the examples shown in FIGS. 2 to 5, the restoring force is generated completely or partially by a helical spring 3 which holds the seismic mass 2 in its first extreme position which is its rest position, as long as no traffic accident occurs. However, in the examples of the invention shown in the other figures, the contact pressure is generated purely magnetically, as will be explained below.

Provided that the sensor has been built into the vehicle as specified with the correct spatial orientation, the contact pressure has such a magnitude that in the event of an accident it will yield or can be overcome in the event of an acceleration or deceleration then acting more or less in the direction of the guide axis, so that the seismic mass 2 then moves more or less rapidly toward its second extreme position.

Figure 2:
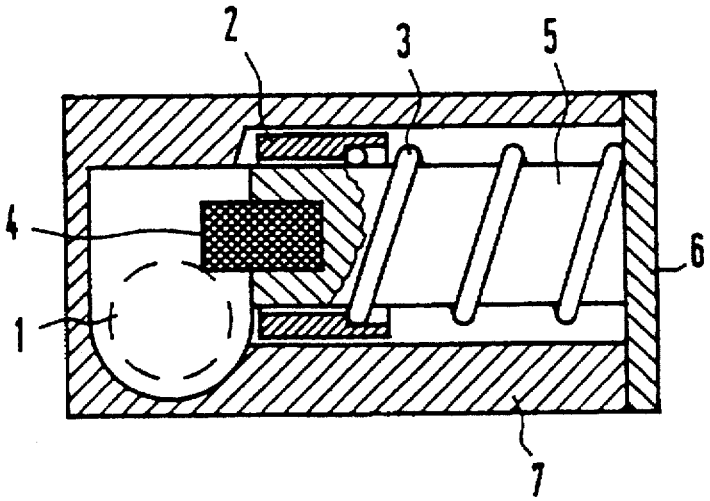
FIG. 2 is a sectional view of a first example of the invention.
Figure 3:
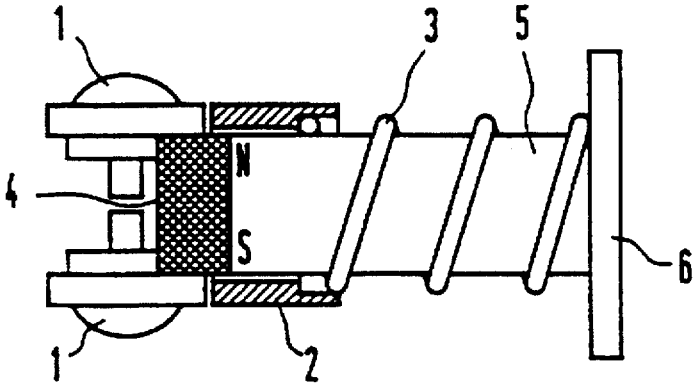
FIGS. 3 to 5 are sectional views of second and third examples of the invention.
Figure 4:
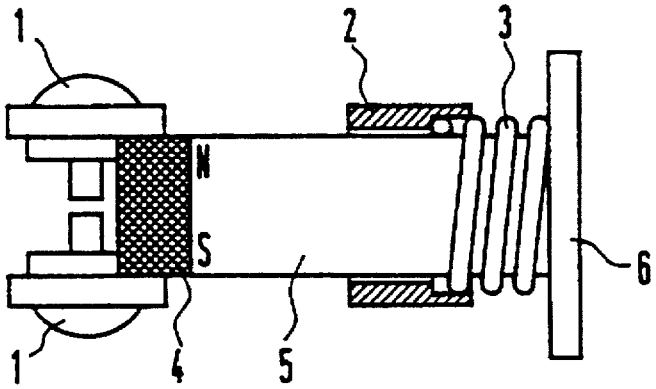

FIGS. 2 and 3 show the same sensor with the seismic mass 2 in the rest position, but rotated by 90°.

Figure 14:
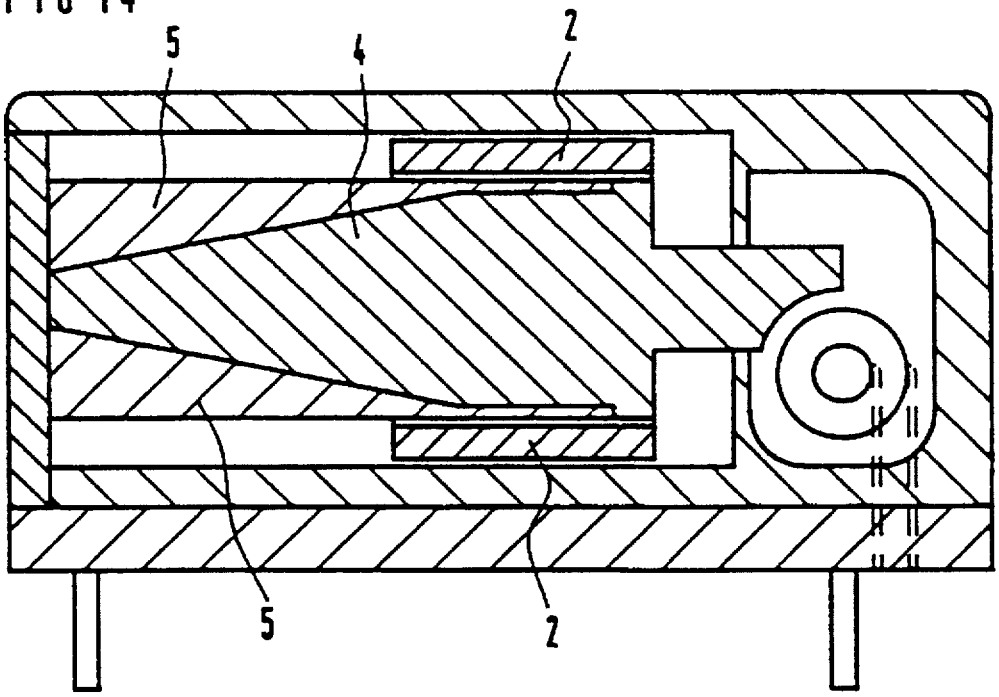
Figure 15:
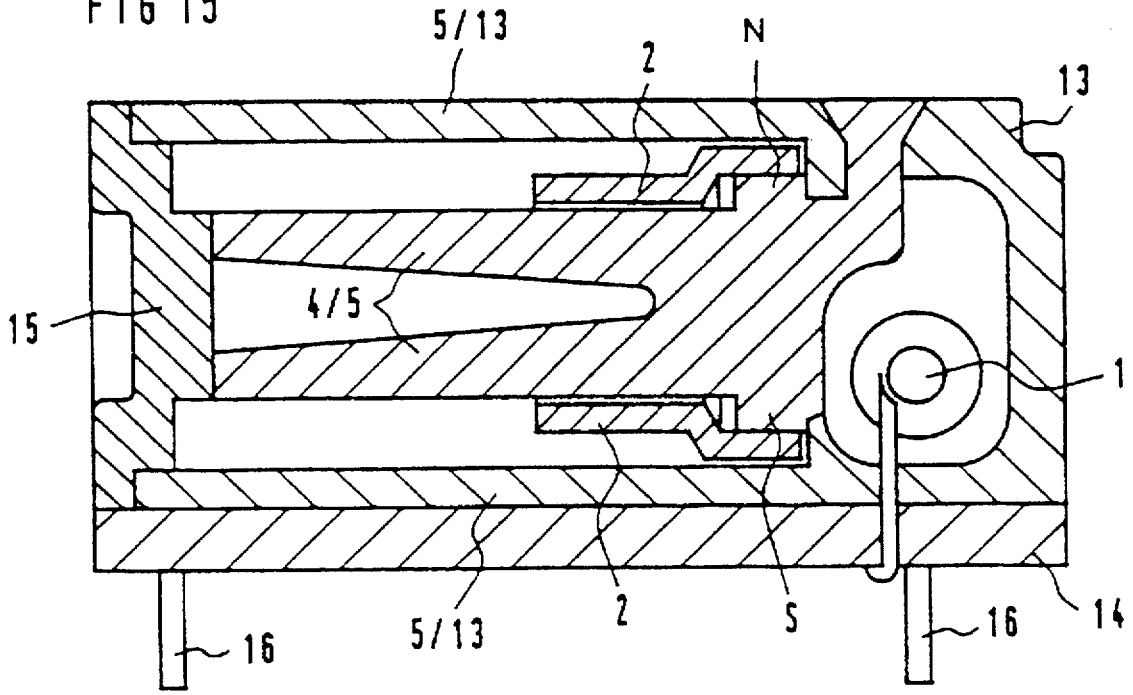
FIGS. 15 and 16 are sectional views of a seventh example of the invention.
Figure 16:
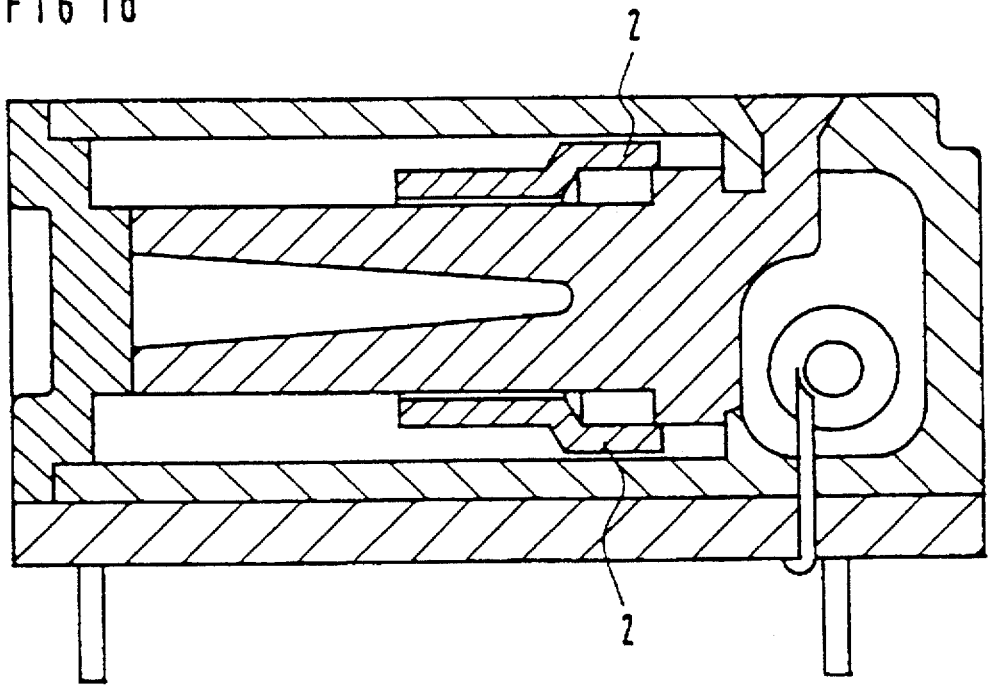

The pairs of FIGS. 3 and 4, FIGS. 9 and 10, FIGS. 11 and 12, FIGS. 13 and 14, as well as FIGS. 15 and 16 differ from one another in each case due to the fact that in the first figure of these pairs of figures the seismic mass 2 is in its rest position in each case, whereas in the other figure of these pairs of figures it is distant from it in each case because a traffic accident has just occurred.

Each sensor has the magnet 4, for example a permanent magnet or an electromagnet, which is distinct from the seismic mass 2. In all of the examples shown the two contacts 1 are fastened to the magnet 4 in such a way that the contacts 1 are lying magnetically in series and the component of the magnetic field of the magnet 4 flows through them, which in addition promotes the switching of the two contacts 1 at the same instant. In this case, the magnet 4 is coupled to the contacts 1 in such a way that its magnetic field controls the contacts 1, due to the fact that its magnetic field is deformed to a varying degree by the seismic mass 2, in fact depending on the position of the low-retentivity seismic mass 2, such as in FIGS. 1 to 5 and 8 to 16 as well as 21. Depending on the position of the seismic mass 2 between its two extreme positions, the deformation of the magnetic field of the magnet 4 namely has different effects on the magnetically controllable contact or contacts 1, such as in FIGS. 1 to 5 and 8 to 16 as well as 21. The contact or contacts 1 is or are namely disposed in such a way and the form of the guide member 5 and the form of the seismic mass 2 are selected in such a way that, in one of its two extreme positions, for example in its first extreme position, that is to say in the rest position of the seismic mass 2, the seismic mass 2 constitutes to a large extent a magnetic shunt diverting the magnetic field away from the contact 1 toward the seismic mass 2. In the direction away from that extreme position, that is to say in the other extreme position, the seismic mass 2 then no longer constitutes such a strong magnetic shunt, so that in the examples shown the magnetic field of the magnet 4 then acts more strongly on the contact or contacts 1.

Depending on its position along the guide member 5, the seismic mass 2 constitutes a strong magnetic shunt at one point, but at another point does not constitute such a shunt or at least only constitutes a weak shunt. By virtue of that fact, despite the constant presence of the magnet 4, it is therefore possible to ensure that in the rest state of the seismic mass 2 the contact or contacts 1 remains or remain in its or their first contact state, that is to say in the non-conductive state, for example. Then, however, when the seismic mass 2 is at points which are sufficiently distant from its rest position, that is to say sufficiently distant from its first extreme position (that is to say in its second extreme position, for example), the contact or contacts 1 is or are controlled in its or their other contact state under the effect of the magnetic field. In the above-mentioned example, therefore, the contact or contacts 1 is or are driven into the conductive contact state when the seismic mass 2 is sufficiently distant from its rest position, such as in FIGS. 1 to 5 and 8 to 16 as well as 21.

According to the invention it is not only possible to construct the guide member 5 in different ways, as was already shown, but it is also possible to construct the magnet 4 in very different ways for the invention. For example, the magnet 4 can itself directly form the guide member 5, or at least quite a substantial part of the guide member 5, such as in FIG. 5 as well as FIGS. 15 and 16. However, the magnet 4 can, for example, also be only connected rigidly to the essentially non-magnetic guide member 5, that is to say, for example, it can form a component of the guide member 5 fastened at one end of the guide member 5, such as in particular in FIGS. 1 to 4 as well as 9 to 16.

One particular feature of the invention is that the magnet 4 is always magnetized more or less perpendicularly with respect to the direction in which the seismic mass 2 can move. In each of the examples of FIGS. 1 to 5 and 8 to 16 as well as 21, the N/S or north/south poles of the magnet 4 are shown. In this case, the seismic, low-retentivity mass 2 constitutes a movable ring, for instance, wherein in the examples shown the ring of the seismic mass 2 either always and completely surrounds the magnet 4 along the whole path between its two extreme positions, or more or less surrounds the magnet 4 at least in the vicinity of the rest position of the magnet 4, such as in particular in FIGS. 1 to 5 and 8 to 16 as well as 21.

In the examples shown in FIGS. 3 to 5 and 9 to 16, the magnet 4 is magnetized parallel to the plane of the paper in each case. The magnet 4 is magnetized perpendicularly to the plane of the paper only in the example shown in FIG. 2. In this manner, according to the invention, the seismic mass 2 can form a magnetic shunt of different strength along the path in each case in dependence on its position, and consequently can influence the contact state differently depending on its position.

As a result, according to the invention, the magnetic field of the magnet 4 crosses the path traversed by the seismic mass 2 in each case in the event of a traffic accident. Eddy currents are produced in the seismic mass 2 during this movement. The eddy currents bring about a certain damping of the movement of the seismic mass 2. In particular, interfering fluttering of the seismic mass 2 is then damped. As a result of eddy currents being produced, in the event of an accident, the seismic mass 2 also has the tendency to move more slowly from the second extreme position back into the rest position again than without eddy currents, with the result that the tendency is for the duration of the actuation of the contacts 1 to increase due to the eddy currents. The strength of the eddy current that flows in a seismic mass 2, and therefore also the damping of the fluttering, depends primarily on the speed of the seismic mass 2, on the strength of the magnetic field within the seismic mass 2 and above all also on the electrical conductivity of the seismic mass 2. In order to increase the eddy currents, in addition to its low-retentivity material, the seismic mass 2 can also have particularly good electrically conductive materials, for example a coating with non-magnetic copper.

The high electrical conductivity of the seismic mass 2 moreover has the advantage of likewise more or less shielding strong, rapidly changing foreign magnetic fields, which are generated by loudspeakers of a car radio, for example, so that these foreign magnetic fields can influence the reliability of the sensor to a correspondingly lesser extent. A similar damping of foreign magnetic fields can be achieved if the housing of the sensor is itself already electrically conductive.

The form of the seismic mass 2 can also be different according to the invention, even if the examples shown in the figures use a circular seismic mass 2 in each case. For example, in the embodiments shown in FIGS. 3 to 5, the ring of the seismic mass 2 has a different cross-section than in FIGS. 9 to 14, which is again different from that in FIGS. 15 and 16. The invention is thus not restricted to a particular cross-section of the ring of the seismic mass 2. The ring can also be non-circular, that is to say it can also be elliptical, for example.

An annular seismic mass 2, which more or less surrounds the magnet at least in the vicinity of its one extreme position, has the advantage of causing strong eddy currents to be produced in this ring during the movement thereof, and therefore strong damping of the fluttering of the seismic mass 2. However, the form of the seismic mass 2 is not restricted to an annular construction. The form of the seismic mass 2 need only be matched to the construction of the guide member 5 and of the configuration of the magnet 4, and possibly also to further circumstances, such as whether or not a spring 3 is (also) used to generate a contact pressure in accordance with FIGS. 3 to 5, for example. In principle, the seismic mass 2 may namely also be formed by a pot-shaped block, for example, into which the magnet 4 can dip and which can also produce eddy currents when the block is moved, such as in FIG. 21, or else by a more or less planar or curved disk. However, in its one extreme position at least, the seismic mass 2 must then always form a strong shunt and at most a much weaker shunt in its other extreme position, or even no shunt at all any more, in order to be able act according to the invention.

The time for the actuation of the contacts 1 depends on the magnetic field strength in the region of the contacts 1, as well as on the force with which the contacts 1 oppose their actuation, that is to say also on the location at which the seismic mass 2 currently finds itself during its movement along the guide member 5, as well as possibly on the spring constant if a spring 3 is fitted, and particularly if the spring in addition has more or less magnetic properties for its part, such as in FIGS. 2 to 5.

It has been shown that with the invention the seismic mass 2 can control the contact state particularly easily during its movement if the contact or contacts 1 is or are disposed more or less near a frontal surface of the guide member 5 in each case, in such a way that the magnetic flux through the contact or contacts 1 is to a high degree dependent on the position of the seismic mass 2. It has proved particularly favorable, as well as space-saving, to place the contact or contacts 1 at a frontal surface of the guide member 5 in such a way that the magnet 4 is essentially disposed between the contact or contacts 1 and the seismic mass 2, at least as long as the seismic mass 2 is located in its second extreme position, that is to say at a great distance from its rest position, such as in FIGS. 1 to 5 and 8 to 16 as well as 21. This is illustrated above all by the general representations of the concept of the invention shown in FIGS. 1 and 8 as well as 21.

All of the examples of the invention shown in the figures contain two so-called Sg-Sm contacts, for instance, which in the present case, particularly as a result of their compactness and robustness, can be constructed in the same way as is described in the Siemens publication entitled: "Schutzgaskontakt in Metallgehäuse [Sealed Contact in Metal Housing] (1972), Publication No. N 109/3651 (1-Bb-7-10725)", and in Published European Application No. 0 489 199.

In many cases it has then proved favorable in particular to place such contacts 1 with their contact housings in the regions of the poles of the magnets 4 approximately in the same way as is illustrated in FIGS. 1 to 5 and 8 to 16 as well as 21. A particular feature of the examples shown in these figures is also that the two Sg-Sm contacts are disposed in such a way that their terminal pins face one another and are separated from one another only by the narrow gap shown in FIGS. 3 to 5 as well as 8 to 10. It is thus a relatively simple matter to fasten the external terminals of the contacts 1 to external terminal pins 16 of the sensor housing, for example by a spot-connection, such as in FIGS. 11 to 16, for instance. The terminal pins 16 are not shown in the other figures for the sake of clarity.

The respective magnet 4 or guide member 5 may be metallic itself, in which case it is then often favorable to avoid an electrical short-circuit between the housings of the contacts, above all if Sg-Sm contacts are employed. It is possible to isolate the housing of the contacts 1 from one another, for example, by placing an insulating layer between at least one of the housings 1 and the magnet 4. However, for insulation purposes, it is also possible to use such a magnetizable plastic member or such an inorganic material as the magnet 4 which constitutes an insulator itself, at least to a large extent.

It can be seen from the illustrated examples that by virtue of the invention it is possible to achieve a space-saving robust configuration, and likewise an uncomplicated, simple manufacture of the merely few components of the sensor. This also applies to the housing of the sensor. All of the examples shown in FIGS. 1 to 5 and 9 to 16 can namely have an injection-molded housing which is made of plastic, for example, on the outside, such as the components 6/7 in FIG. 2 as well as 9/10, 11/12/15 and 13/14/15 in FIGS. 11 to 16 which are only very diagrammatically shown for the sake of simplicity. The injection-molded part may then be constructed in each case in such a way that it has more or less one axis, in which the guide axis of the guide member 5 is disposed and on which the seismic mass 2 made of soft iron is placed, for example, as a movable circular ring 2. In the example shown in FIGS. 11 and 12, the magnet 4, which is co-utilized in this case as the guide member 5 at the same time, is fastened rigidly to the injection-molded part 11 of the housing by casting, with both being constructed, such as the elements 5/11, in such a way that together they constitute the guide member 5. The housing 8 shown in FIG. 5 can also be produced in a similar manner, although the details of the housing construction are omitted therein, only for the sake of clarity.

Expediently, the magnet 4 can often only be subsequently magnetized after the configuration of the injection-molded housing, if one does not prefer to use a magnet 4 that is magnetized from the outset, or a magnetically hard guide member 5 that is magnetized from the outset, such as in particular in FIGS. 2 to 5 and 11 to 16.

FIGS. 8 to 16 as well as 21 show examples in which the spring 3 has been dispensed with, such as is also done in FIGS. 2 to 5. It is namely possible to produce a restoring force to replace the spring force by an appropriate construction of the magnetic field of the magnet 4. In addition to the spring 3, it is also possible to construct the magnetic field in such a way that it assists the effect of the spring 3, that is to say it makes it possible to use a comparatively weak spring 3.

Figure 5:
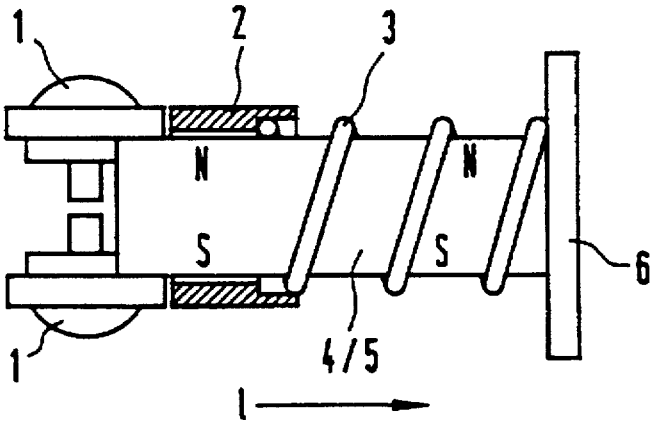
Figure 6:
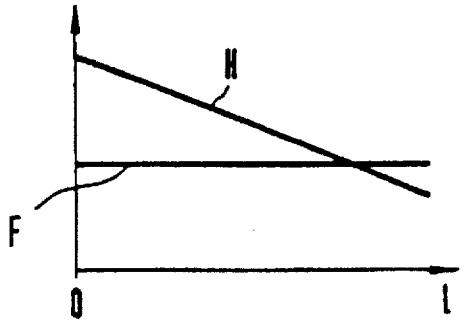
FIGS. 6 and 7 are diagrams showing a dependence of a magnetically generated restoring force on a strength of a magnetic flux through a seismic mass.
Figure 7:
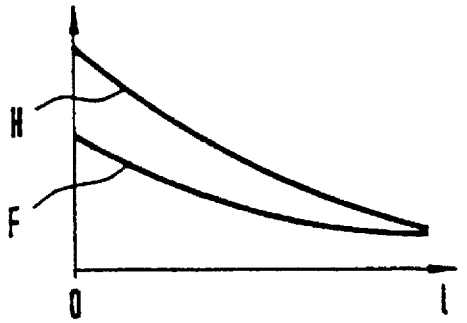

In order for a magnetic restoring force to act on the seismic mass 2 at every point between its extreme positions, which force pulls the seismic mass 2 back into its rest position if there is no acceleration or if there is no deceleration, respectively, the magnet 4 can be constructed in such a way that during the movement of the seismic mass 2 along a path l from its first to its second extreme position, the magnetic field component flowing through the seismic mass 2 constantly decreases, and therefore the magnetic flux flowing through the contact or contacts 1 constantly increases, such as in FIGS. 6 and 7. It is assumed in this case initially that in the example of the invention shown in FIG. 5, an uneven magnetization H of the magnet 4/5 being co-utilized as the guide member 5 was applied, with the magnet 4 occupying the entire length between the contacts 1 and an end plate 6 of the external sensor housing. According to FIG. 6, the decrease in the strength H of the magnetic field N/S along the path l is approximately linear, for instance. The decrease may also be strongly non-linear, such as in the example shown in FIG. 7. The low-retentivity seismic mass 2 is always magnetically drawn toward the extreme position in which the magnetic flux through the seismic mass 2 is at its maximum, that is to say to the left toward the contacts 1 in FIGS. 6 and 7 as well as 2 and 3. If the sensor according to the invention is dimensioned in such a way that the H-l characteristic curve is substantially non-linear, then, depending on its location to a substantial extent, the seismic mass 2 is accordingly pulled back into its rest position with a restoring force F that can be defined in advance by the manufacturer. This represents a possibility for varying the restoring force which would hardly be possible to realize in the same manner with springs 3. By virtue of this possibility for variation, it is also possible to considerably vary the dwell time of the seismic mass 2 in advance, that is to say the time that the mass 2 remains distant from its rest position when the accident occurs, and therefore also the duration of the closure of the contact or contacts 1. In particular, it is also possible to achieve the very long dwell times that are frequently desired, which is likewise hardly possible to achieve with springs 3.

Thus, if one replaces the springs 3 completely by a correspondingly constructed magnetization H, which namely decreases, at least in the vicinity of l=NULL, as l increases, then the "first extreme position" in which the seismic mass 2 forms a strong magnetic shunt is always the rest position of the seismic mass 2. However, the invention also relates to such variants in which a spring presses the seismic mass 2 into its "second extreme position" as a rest position in which the seismic mass 2 does not form a magnetic shunt, or only forms a weak magnetic shunt.

FIG. 6 shows that given linearity, a largely constant restoring force F is produced, since the seismic mass 2 is pressed back to its rest position at every point l with a more or less constant force F. If, on the other hand, a non-linear magnetization was applied along the path l, then it would be possible to obtain correspondingly deviating characteristic curves for the dependence of the restoring force on the point l, such as in FIG. 7. As can be seen from FIGS. 6 and 7, it is also possible to cause the restoring force F to be at a maximum as long as the seismic mass 2 is in its rest position while the restoring force is then decreasing at other points.

The characteristic curve shown in FIG. 7 can also be readily obtained, such as in FIG. 5, if the magnetizable space 4 within the guide member 5 has a constant cross-section and identical material everywhere along the path l of the seismic mass 2. For this purpose, it is namely possible to obtain the different magnetization H essentially by varying the strength of application of the magnetic field in the magnet 4. The magnet 4 thus has a varying strength applied, as viewed along the direction of movement of the seismic mass 2. It is, however, also possible to vary the cross-section of the magnet 4 along the guide member 5, and therefore to match the line of the characteristic curves H and F to the respective requirements, such as also in the representations of the concept of the invention shown in FIGS. 8 and 21 in this respect.

It is therefore even possible to apply constant magnetization to the magnet 4 if one makes the form of the magnet 4, that is co-utilized as guide member 5, for example, variable along the path l by means of bores and/or outer beveling and/or by the selection of different magnetically hard materials for a magnet 4 which is constructed in layers. By varying the magnetic properties of the magnet 4, it is comparatively easy to match the sensor to different types of cars and different installation sites in the car, even if the guide member 4/5 constitutes a magnet 4 along its entire length, such as in FIGS. 9 to 16. If the magnetic field strength H in the seismic mass 2 is in the vicinity of its rest position, and the variation of the strength H along the axis of the guide member 5 is of sufficient magnitude, it is therefore also possible to dispense entirely with a spring 3 because the eddy current braking in the region of the rest position is high enough to suppress fluttering of the seismic mass 2 in the vicinity of the rest position. A particularly simple construction of the sensor is therefore achieved if the contact pressure effective in the rest position of the seismic mass 2, apart from usually negligible side effects such as gravitation, is formed solely by the magnetically generated restoring force F.

A comparatively large force is required to move the seismic mass 2 out of its rest position if the magnetic restoring force F, possibly assisted by the restoring force of an additionally disposed spring 3, holds the seismic mass 2 in its rest position with a considerable contact pressure. Even if no additional spring 3 is disposed, comparatively large forces are required to move the seismic mass 2 out of its rest position because it is necessary to overcome not only the magnetic restoring force F but also friction forces. Depending on the type of vehicle, the contact pressure/restoring force F effective in the rest position should be optimized, depending on the deceleration values at which the respective sensor is to trigger the passenger protection system therein.

In order to reduce the friction between the seismic mass 2 and the guide member 5, it is possible to use a low-friction material for the latter, or at least for its relevant surfaces.

It is also noted that the non-linearity of the characteristic curves can also be achieved by not magnetizing the entire guide member 5 shown in FIG. 5, but only a more or less small and perhaps beveled portion 4 thereof in accordance with FIGS. 2 to 4 and 8 to 10 as well as 21, for example. The rest of the guide member 5 is then made of non-magnetic plastic, for example. The invention thus expediently permits a number of ways of influencing the characteristic curves.

Even if the magnetization H in accordance with FIGS. 6 and 7 along the axis l of the guide member 4/5 is not constant, clear eddy current braking forces occur during movement of the seismic mass 2. The braking forces become smaller as the variation of the field strength H as a function of the variation in the position l of the seismic mass 2 becomes smaller.

Figure 17:
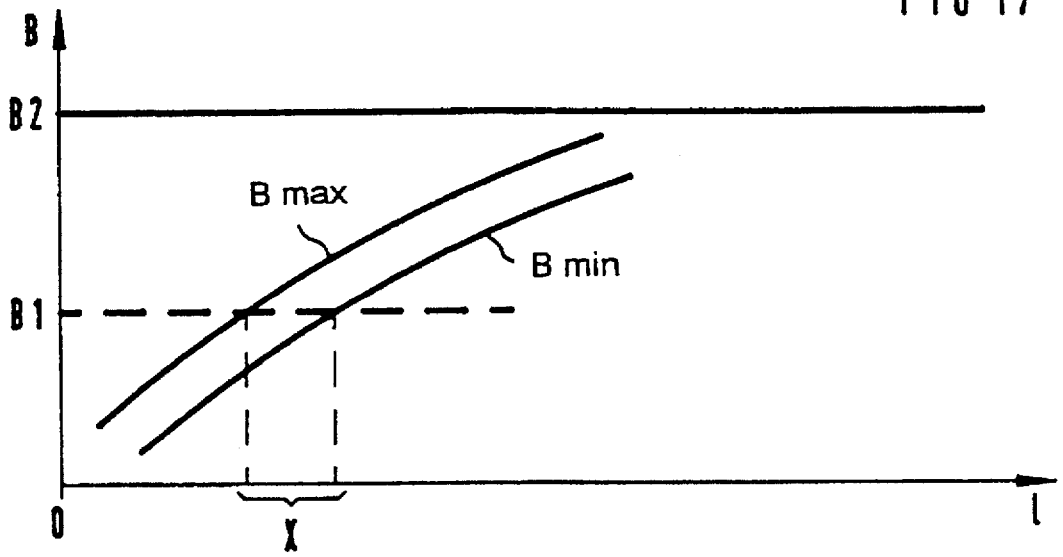
FIGS. 17 to 20 are diagrams showing a dependence of a magnetic flux through contacts on a position of a seismic mass and on tolerances.

The dependence of the magnetization H on the path l also has an influence on the switching behavior of the contact or contacts 1. It is namely also possible to influence the reliability of the switching of the contacts by appropriate configuration of the respective H-l characteristic curve:

The faster the magnetization H in the moved seismic mass 2 decreases, as a function of the path l, the faster the magnetic flux B through the contacts 1 also increases, as a function of the path l, and at the same time the smaller the tolerances of X at which the contact 1 switches, such as in FIG. 17. In FIG. 17, reference symbol B2 designates the magnetic flux through the contact 1 when the seismic mass 2 is in its second extreme position (l=maximum), and reference symbol B1 designates the magnetic flux at which the contact 1 just switches. The tolerance X is produced above all by the tolerances (manufacturing, aging, temperature, as well as material properties, etc.) of the magnetization and the form of the magnet 4, and the form and the material properties of the seismic mass 2 as well as of the guide member 5, such as Bmax and Bmin.

Figure 18:
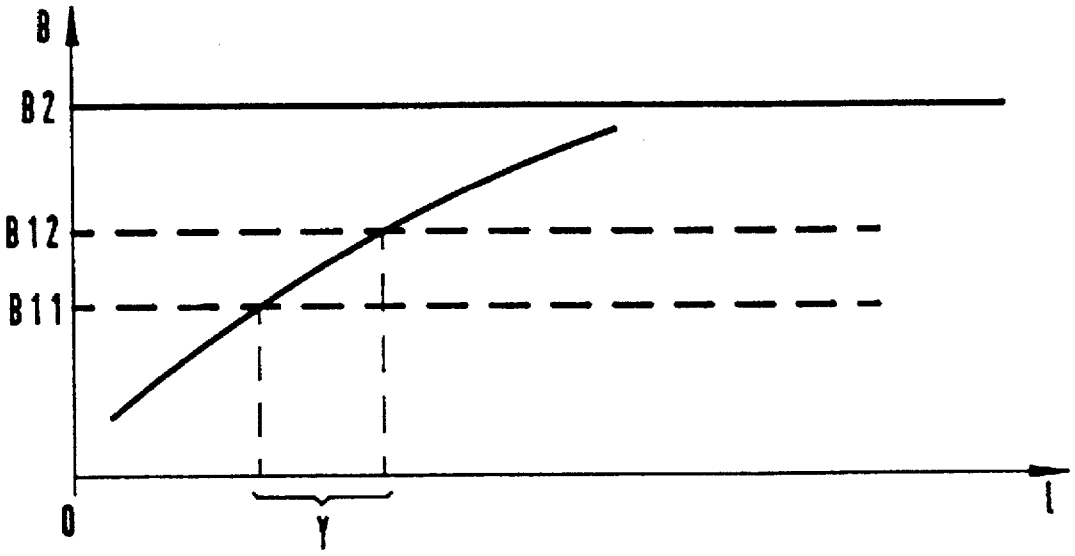

The tolerance X is overlaid by a further tolerance Y which is produced by manufacturing tolerances (manufacturing, ageing and temperature, as well as material properties, etc.) of the contact 1 itself and is illustrated in FIG. 18. In this case reference symbol B11 designates the minimum value and reference symbol B12 designates the maximum value of the magnetic flux B1 at which the respective contact 1 switches due to its manufacturing tolerance.

Both the tolerance X shown in FIG. 17 and the tolerance Y shown in FIG. 18 in each case become smaller as the respective B-l characteristic curve becomes steeper in the region B1/B11/B12 in the diagram. Above all, the further developments of the invention, which are shown in FIGS. 11 to 16 and in which a particularly steep step-like characteristic curve section is disposed in their B-l characteristic curve, are based on this finding:

For this purpose the strength of the magnetization H of the guide member 5, or of the magnet 4 respectively, is selected locally in these examples to be distant from the two extreme positions, at a point that can be predetermined by the manufacturer along the direction of movement of the seismic mass 2, in such a way that when the seismic mass 2 moves along the guide member 5, the magnetic field component flowing through the seismic mass 2 in each case has a sudden change in strength at this particular point l between the extreme positions of the seismic mass 2. Namely, the magnetic flux B through the contact or contacts 1 also changes suddenly as soon as the seismic mass 2 moves past the point. The corresponding magnetic steps, which are shown in particular in FIGS. 11 to 16, therefore have the effect of ensuring that the magnetic flux through the contacts 1 is also changed almost instantly whenever the seismic mass 2 passes through the magnetic step in each case, which results in a precise switching of each contact 1 at this point of the seismic mass 2.

Figure 12:
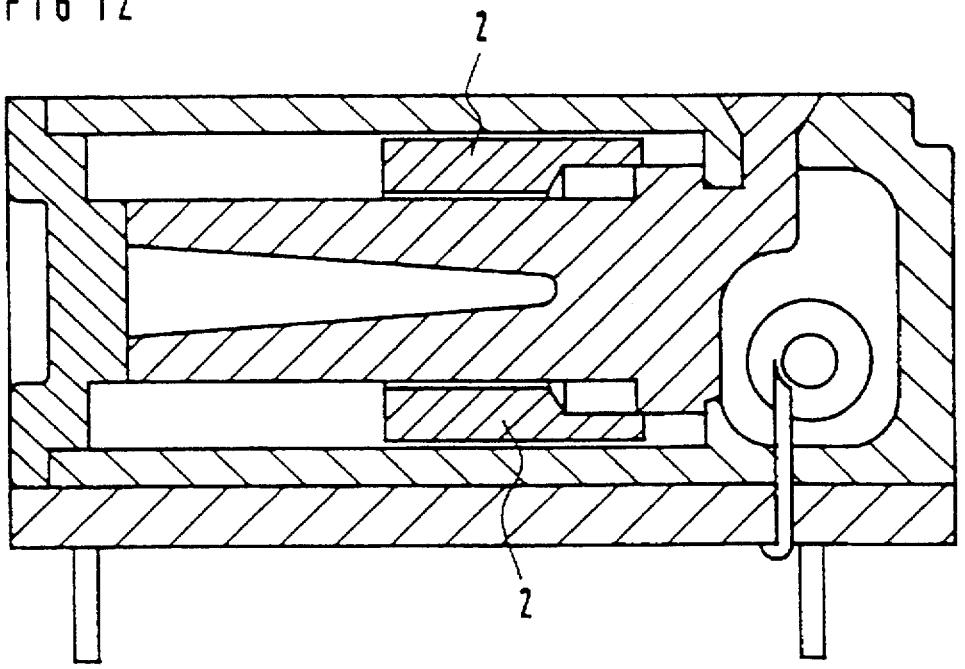
Figure 13:
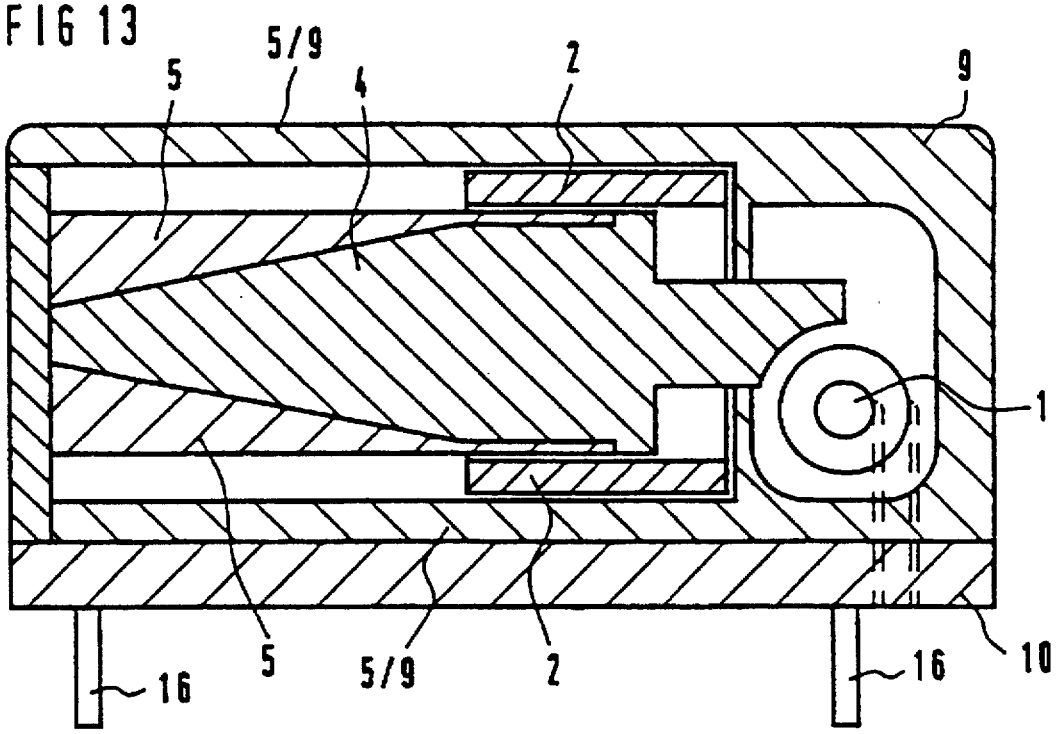
FIGS. 13 and 14 are sectional views of a sixth example of the invention.

The respective step which is magnetically effective on the guide member 5 is therefore dimensioned there in such a way that the tolerances X and Y are very small when the contact 1 is closed, such as is also in FIGS. 12, 14 and 16 above all, that show approximately the position of the seismic mass 2 during the switching of the contacts 1. The path described by the seismic mass 2 until it reaches the magnetic step can be defined precisely, for example by a gage in the injection tool for the sensor housing, with the result that it is subject to correspondingly low tolerances.

Figure 19:
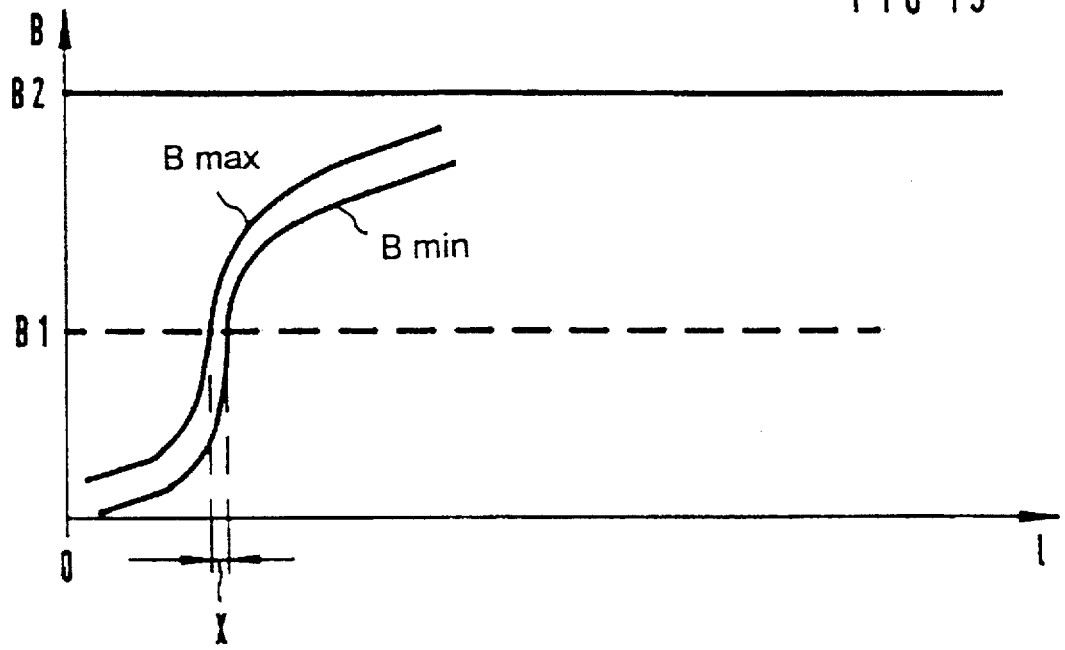
Figure 20:
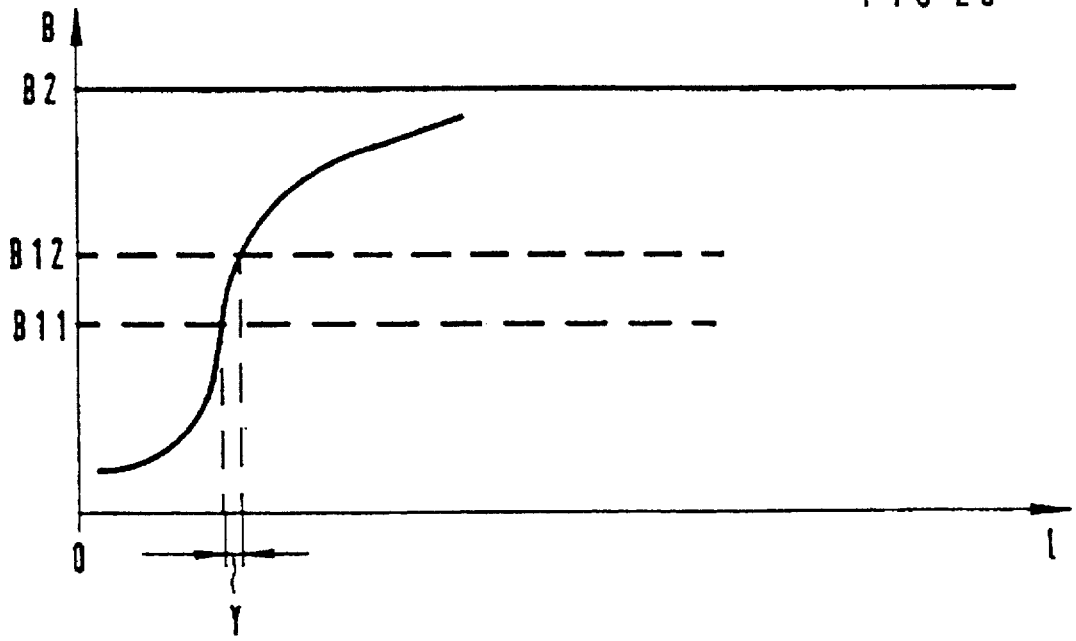

FIGS. 19 and 20 diagrammatically show the influences of the switching thresholds B1/B11/B12 by way of example when these steps are provided. The figures illustrate particularly clearly that due to the steps, the tolerances X and Y of the threshold values, which occur both as a result of manufacturing tolerances and as a result of temperature influence, ageing, etc. in the region of the step-like jump, are in each case so low that it is often even possible to omit an individual sensor comparison when the steps have been introduced. As a result, it is even possible to use a relatively inexpensive magnet material because it is not necessary to promote any particularly high temperature stability.

The path l of the seismic mass 2 until the sudden closure of the contact 1 is therefore defined in this case less by the absolute level of the local strength B of the magnetic field in the contact 1, and not by other variables or factors such as temperature, hysteresis and ageing which are associated with considerable tolerances, but above all by the geometrically stepped shape of the magnet 4, such as in FIG. 12, in which the seismic mass 2 is just leaving the step following an accident. This similarly also applies to the examples shown in FIGS. 13 and 14 as well as to those shown in FIGS. 15 and 16. In this case, too, the magnet 4 has a pronounced geometric stepping or corner which enables the contacts 1 to be switched suddenly.

Figure 11:
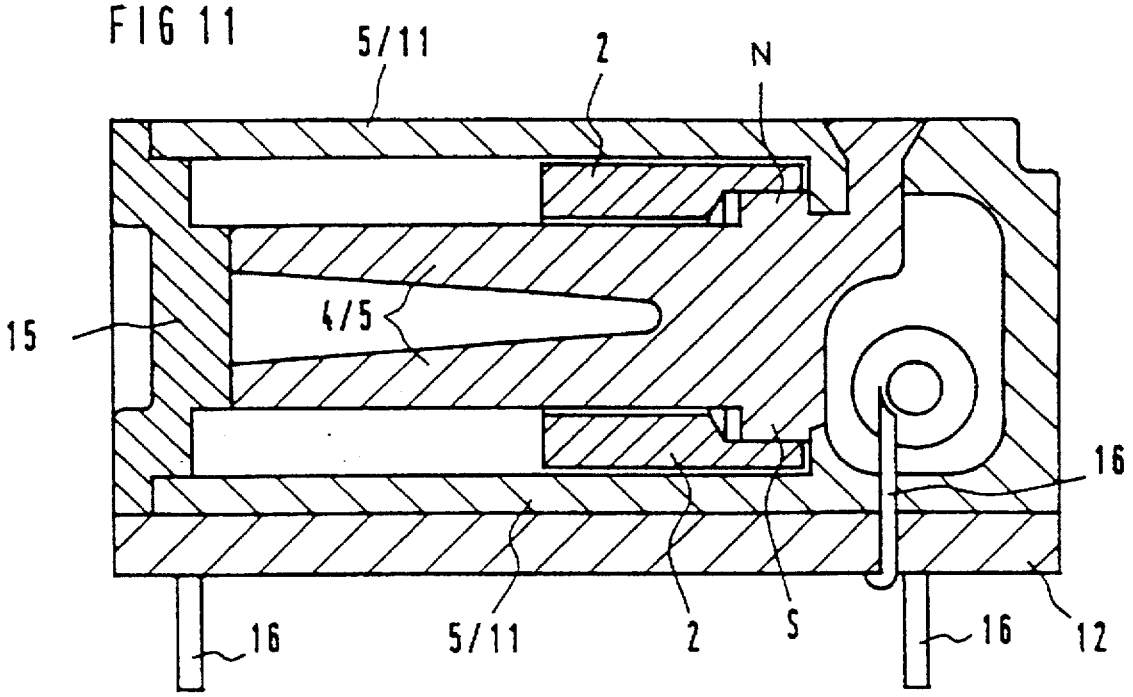
FIGS. 11 and 12 are sectional views of a fifth example of the invention.

The special example of the invention, with a stepping of the magnet 4/5 generated geometrically in the vicinity of the rest position, which is illustrated in FIGS. 11 and 12, has the advantage of achieving the particularly stable response threshold particularly close to the rest position of the seismic mass 2 as a result of the stepping.

It is noted that in FIGS. 11 to 16 the magnet 4 in each case has a relatively small short extension in the direction of the contacts 1, through which the magnetic flux B preferably flows through the contacts 1.

Moreover, in the examples shown in FIGS. 9 to 16, the sensor always operates without a restoring spring. The magnetic field of the magnet 4 is namely constructed in such a way that it generates a sufficient magnetic restoring force itself on the seismic mass 2, so that in times when no accident has occurred, the seismic mass 2 is pulled back into its rest position even without a spring and is held there in a stable manner by the magnetically generated contact pressure F.

In the further developments shown in FIGS. 11 to 16, the value of the magnetic flux along the path l flowing through the seismic mass 2 thus likewise has at least a single step. In these examples, the contact or contacts 1 is or are switched suddenly and in fact as a result of a sudden change in the strength of the magnetic flux B flowing through it or them, due to the fact that the magnetization of the magnet 4 acting on the seismic mass 2 suddenly changes at this point of the path l, which is due to the geometric construction of the guide member 5 and/or of the magnet 4, and/or is due to the magnetization of the magnet 4, and is selected in such a way that a jump in the magnetization intensity H is produced if the seismic mass 2 is moved at the respective point 1. The magnetic flux B through the contact or contacts 1 then likewise changes suddenly when the seismic mass 2 moves past the point l, which has a sudden magnetic step.

We claim:

1. A traffic accident detecting sensor for a passenger protection system in a vehicle, comprising:

a guide member having a guide axis extending in a given direction and having at least one end surface;

a hollow low-retentivity seismic mass with an axis coaxially disposed with said guide axis of said guide member, said Seismic mass being guided by said guide member for movement along said guide axis in a given direction between first and second extreme positions;

means for normally pressing said seismic mass into said first extreme position with a contact pressure yielding in the event of an acceleration or a deceleration acting substantially in said given direction of said guide axis for moving said seismic mass toward said second extreme position;

a magnet distinct from said seismic mass, said magnet having a magnetic field being deformed to a varying degree by said seismic mass in dependence on a position of said seismic mass;

at least one contact to be controlled by the magnetic field of said magnet by directing a magnetic flux through said at least one contact in dependence on the position of said seismic mass;

said at least one contact and said seismic mass causing said seismic mass to constitute a strong magnetic shunt to a substantial extent in said first extreme position and diverting the magnetic field away from said at least one contact and toward said seismic mass, for maintaining said at least one contact in a first contact state as long as said seismic mass remains in said first extreme position, despite the presence of the magnetic field, and for reducing a magnetic shunt constituted by said seismic mass, at points distant from said first extreme position, for then controlling said at least one contact in another contact state under an effect of the magnetic field;

said guide member having a strength of magnetization locally along said given direction of movement of said seismic mass, for constantly increasing a magnetic field component flowing through said seismic mass, and constantly decreasing the magnetic flux flowing through said at least one contact, during the movement of said seismic mass from said second extreme position to said first extreme position.

2. The sensor according to claim 1, wherein said magnet forms said guide member.

3. The sensor according to claim 1, wherein said magnet is rigidly connected to said guide member.

4. The sensor according to claim 1, wherein said guide member has a strength of magnetization locally along said given direction of movement of said seismic mass, for causing a magnetic field component flowing through said seismic mass to have a sudden change in strength at a point between said extreme positions of said seismic mass, during movement of said seismic mass along said guide member.

5. The sensor according to claim 4, wherein the sudden change in strength is caused by a geometric construction of said guide member causing the magnetic flux through said at least one contact to change suddenly as soon as said seismic mass moves past said point.

6. The sensor according to claim 1, wherein the contact pressure is at least substantially generated by the magnetic flux flowing through said seismic mass.

7. The sensor according to claim 1, wherein said seismic mass is at least partially made of electrically conductive material.

8. The sensor according to claim 1, which further comprises an injection-molded housing enclosing said guide member and said seismic mass.

9. The sensor according to claim 1, wherein said pressing means is a helical spring coaxially disposed about said guide member.

10. The sensor according to claim 1, wherein said at least one contact disposed substantially near an end surface of said guide member.

11. The sensor according to claim 1, wherein said seismic mass is a hollow tube.

* * * * *